United States Patent [19]

Johnson

[11] Patent Number: 4,938,362

[45] Date of Patent: Jul. 3, 1990

[54] OPENER FOR PACKAGES

[75] Inventor: Barbara J. Johnson, Brookfield, Conn.

[73] Assignee: Nestec S.A., Vevey, Switzerland

[21] Appl. No.: 219,603

[22] Filed: Jul. 15, 1988

Related U.S. Application Data

[63] Continuation-in-part of Ser. No. 162,428, Mar. 1, 1988.

[51] Int. Cl.[5] ..... B65D 17/30

[52] U.S. Cl. ..... 206/603; 206/632; 206/806

[58] Field of Search ..... 206/603, 633, 630, 806, 206/632

[56] References Cited

U.S. PATENT DOCUMENTS

| | | | |
|---|---|---|---|
| 1,816,835 | 8/1931 | Fischer | 206/603 |
| 1,929,599 | 10/1933 | Millholland | 206/603 |
| 1,951,343 | 3/1934 | Butts et al. | 206/603 |
| 2,082,760 | 6/1937 | Berni | 206/603 |
| 2,132,741 | 10/1938 | Kyseth | 206/603 |
| 2,459,130 | 1/1949 | Jones | 206/603 |
| 2,992,118 | 4/1961 | Daline | 206/603 |
| 3,220,598 | 11/1965 | Fried et al. | 206/603 |
| 3,882,999 | 5/1975 | Wellman | 206/603 |
| 3,900,105 | 8/1975 | Wolfelspergel | 206/604 |
| 4,027,819 | 6/1977 | Herrera-Gutierrez | 206/603 |
| 4,101,042 | 7/1978 | Strong et al. | 206/806 |
| 4,150,747 | 4/1979 | Gordon | 206/603 |
| 4,184,597 | 1/1980 | Gavin | 206/806 |
| 4,420,080 | 12/1983 | Nakamura | 206/632 |
| 4,444,610 | 4/1984 | Torterotot et al. | 206/603 |
| 4,712,671 | 12/1987 | Salacuse | 206/806 |

*Primary Examiner*—Paul T. Sewell
*Assistant Examiner*—Jacob K. Ackun, Jr.
*Attorney, Agent, or Firm*—Vogt & O'Donnell

[57] ABSTRACT

A device for aiding the opening of a flexible package is embodied by a tab which provides a cutter having at least one cutting edge for piercing a flexible surface of a package. In one embodiment, the tab is planar and is secured to a package such that it may be removed for piercing a flexible surface of the package by the at least one cutting edge of the cutter for opening the package. In another embodiment, the tab, which is made of a resilient material, is planar and contains at least one line of weakening defining a cutter having at least one cutting edge. The at least one line of weakening enables, by finger pressure, making the cutter effective by enabling breaking the cutter from the remainder of the tab at the at least one line of weakening. In a further embodiment, the tab is defined by two portions wherein a first portion of the tab is secured to the package and a second portion contains lines of weakening defining the cutter thereby enabling the cutter to be broken from the remainder of the tab at the lines of weakening and bent out of the plane of the second tab portion to enable piercing the flexible surface of the package for opening the package. Another embodiment contemplates the tab being a part of the flange of the package from which the tab may be broken at at least score one line and bent to pierce a flexible surface of the package for opening the package.

17 Claims, 7 Drawing Sheets

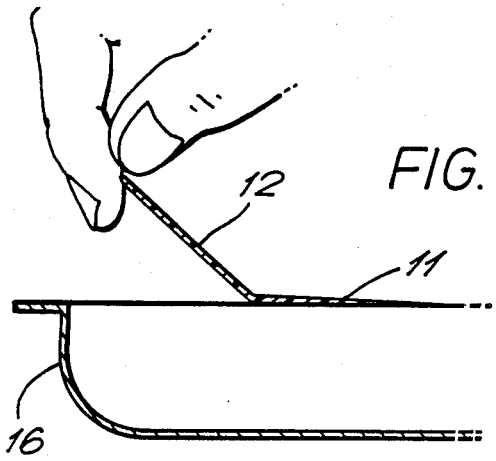
FIG. 17.
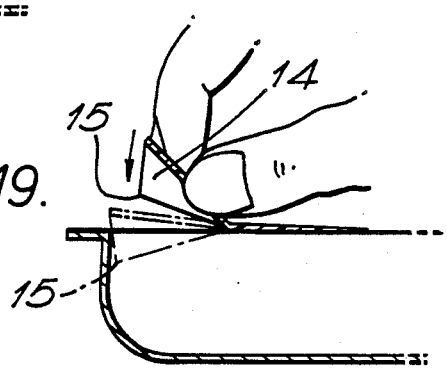
FIG. 19.
FIG. 18.
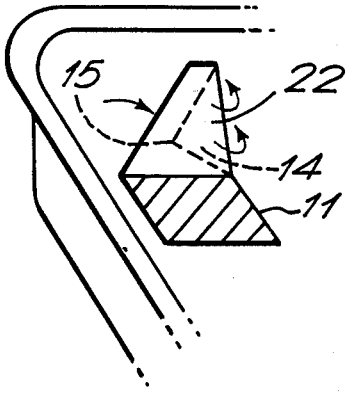
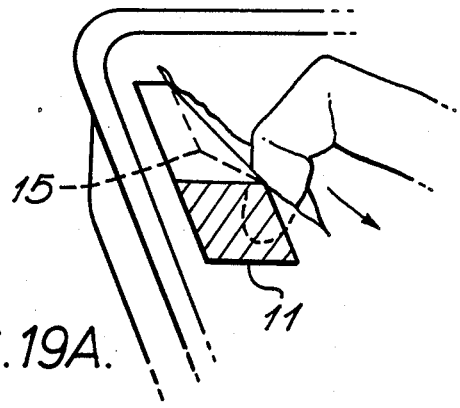
FIG. 19A.

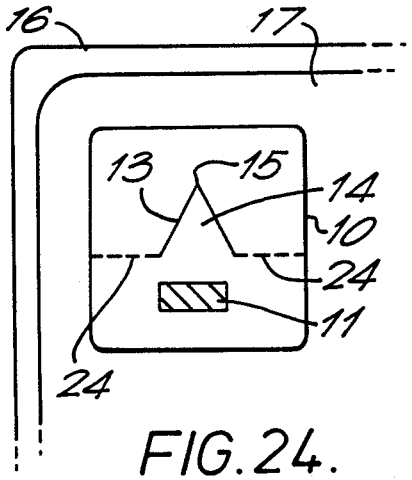
FIG. 24.
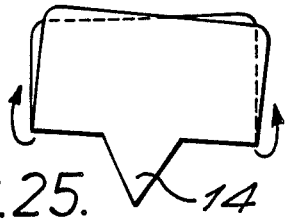
FIG. 25.
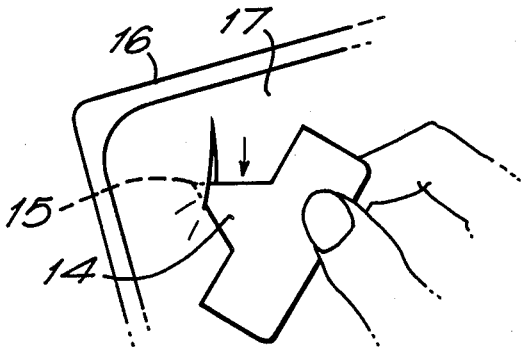
FIG. 26.
FIG. 27.
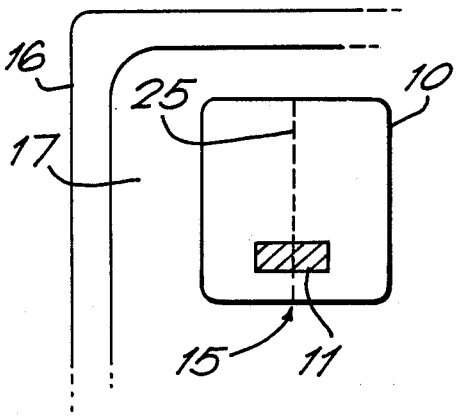
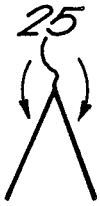
FIG. 28.
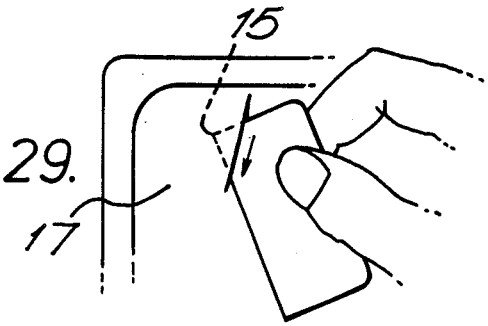
FIG. 29.

OPENER FOR PACKAGES

CROSS-REFERENCE TO RELATED APPLICATIONS

This application is a continuation-in-part application of co-pending application Ser. No. 07/162,428, filed March 1, 1988.

BACKGROUND OF THE INVENTION

The present invention relates to a means which aids in the opening of a flexible package.

On most types of "difficult to open" flexible packages, especially for soft products such as pastas, sauces and cheese, printed instructions for opening by cutting with a knife or scissors is commonplace. It would however be more convenient for the cunsumer if such packages had an easy opening mechanism which did not require the use of tools which may not always be readily available.

SUMMARY OF THE INVENTION

We have now developed a means to aid the opening of a flexible package which means is either secured to the package or is built into the package.

The present invention, therefore, provides a means which aids in the opening of a flexible package comprising a tab made of a resilient material, lines of weakening defining a cutter capable of piercing the lidding material of the package, said lines of weakening capable of being bent, broken or torn by finger pressure on the tab to expose or make effective the cutting edge of the cutter. The present invention also includes a package having the described opening means integral with or secured to the package.

DETAILED DESCRIPTION OF THE INVENTION

By "flexible package" in this invention we mean a package in which one or more surfaces is flexible in nature e.g. a lid or top membrane herein referred to as the "lidding material". The package body may be made of plastics material, foil, thin paper or laminates, etc. The tab may be made of a rigid or semi-rigid material such as a thin metal, wood or heavy gauge plastic and is preferably a slightly flexible material, e.g., polyester, PVC, high impact polystyrene and other thermoplastics.

The lines of weakening may be for example, scores, cuts, incisions, indents, notches, grooves or perforations, etc., and may be formed by conventional methods of forming scorelines or by partially or completely breaking through the material of the tab, for instance by die cutting, stamping, punching or perforating. Desirably, the configuration of the lines of weakening ensures that the cutting edge of the cutter is held intact before use, for example, during storage and distribution so that there are no sharp edges or points exposed which could be dangerous during handling or which could rupture the package.

When the tab is integral with the package it is conveniently positioned around the rim or flange of the package and the lines of weakening are formed in that part of the package where they may be broken or torn to expose or make effective the cutting edge of the cutter of the tab.

When the tab is secured to the package, the lines of weakening are usually in the tab which is advantageously adhered to the lidding material by means of an adhesive. The adhesive should be capable of withstanding temperature changes and abuse in the distribution environment. It may be applied onto the material of the tab either directly or by means of a carrier material such as polyester tape and should be aggressive enough to hold the tab to the package. Alternatively, a double-sided adhesive may be used wherein adhesive is present on both sides of a carrier material, one side adhering aggresively to the package and the other side securing the tab to the carrier material and thus holding the tab to the package. In this case, the tab may be removed completely and the adhesive remaining on the exposed surface of the carrier material may, if desired, serve to reseal the opened package.

The cutter that is defined by the lines of weakening advantageously has a cutting edge with one or more pointed ends or it may be serrated. Preferably, the lines of weakening do not surround the whole of the cutter so that when the lines of weakening are bent, broken or torn by finger pressure, at least part of the non-cutting edge of the cutter usually remains attached to the tab, but can be broken away with additional force. This enables the consumer to pierce the lidding material of the package with the cutting edge of the cutter while holding the tab, preferably ensuring that the cutting edge pierces substantially at right angles to the lidding material. After piercing the lidding material, the consumer may pull back the lidding material and the tab with the attached cutter to peel open the package. In some cases, the tab body stays intact with the package while the cutter breaks away and is removed with the lidding material. In one embodiment the cutter is provided with one or more pointed ends as well as serrations. In this case, the serrated edge is preferably exposed rather than being defined by lines of weakening in the tab. The presence of the serrations enables the consumer to pierce the lidding material with the serrated edge rather like a saw blade and then to complete the cutting by means of the cutting edge provided with one or more pointed ends.

Advantageously, the tab may be provided with a hole or notch which enables the package to be hung, for example, while on display in the retail centres. Normally, the package is displayed in a near horizontal position which inhibits product display characteristics, whereas when the tab is provided with a hole or notch, the package can be displayed by hanging to enhance display characteristics, and, in addition, all but the front package may be largely protected from visible light degradation.

The thickness of the tab may be from 0.1 to 1 mm but is more usually from 0.2 to 0.6 mm, preferably from 0.3 to 0.5 mm. The length and breadth of the tab may vary according to the dimensions of the package and, typically, the length may be from 2 to 10 cm, more usually 4 to 8 cm while the breadth may be from 1 to 5 cm, more usually from 2 to 4 cm.

The present invention will now be further illustrated, by way of example only, by reference to the accompanying drawings.

BRIEF DESCRIPTION OF THE DRAWINGS

FIGS. 17–19 illustrate the steps of opening a package by means of the tab represented in FIG. 10.

FIGS. 24–26 and 27–29 illustrate two designs of tab which are folded in half to expose the cutting edge and removed from the package and;

DETAILED DESCRIPTION OF THE DRAWINGS

Figure 1:
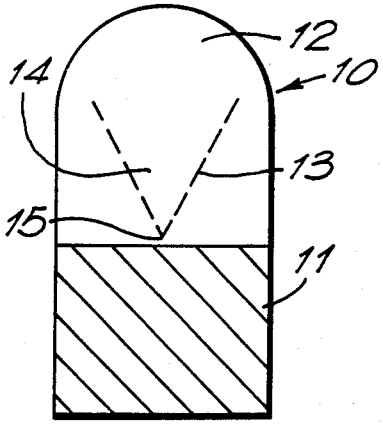
FIG. 1 represents one form of tab according to the present invention.
Figure 2:
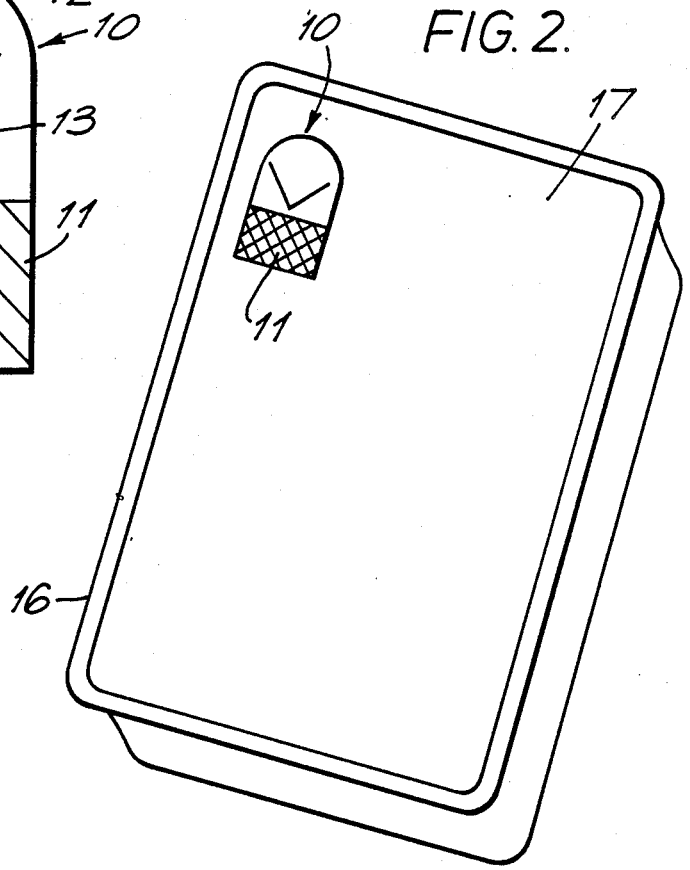
FIG. 2 shows a tab of FIG. 1 adhered to a package.
Figure 3:
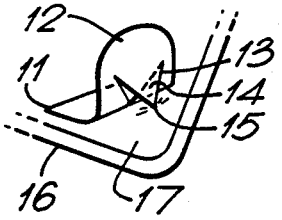
FIGS. 3–5 illustrate the steps of opening the package by means of the tab adhered as in FIG. 2.
Figure 4:
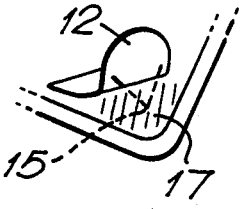
Figure 5:
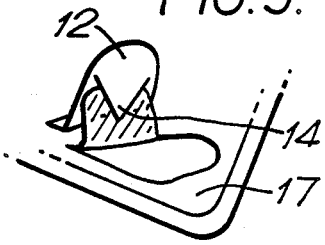

Referring to the drawings, FIG. 1 represents a tab generally designated (10) made of rigid slightly flexible PVC sheet material 0.4 mm thick having a strong adhesive (11) on a first portion of the tab and having a second tab portion (12) which can be gripped and pulled up with the fingers and which contains perforated pre-cut "V" score lines (13) defining a cutter (14) with a pointed end (15). FIG. 2 represents a flexible package (16) to which is adhered the tab (10) by means of the first portion of the tab having adhesive (11) on the lidding material (17). To open the package, the second portion (12) of the tab is pulled up by the fingers, then the "V" shaped score lines (13) are broken by the thumb and the cutter (14) is pushed out towards the package as shown in FIG. 3. The cutter is then pierced through the lidding material (17) by its pointed end (15) as shown in FIG. 4 and then the lidding material and the tab are pulled back as one unit with the fingers as shown in FIG. 5 to peel off the lidding material to open the package.

Figure 6:
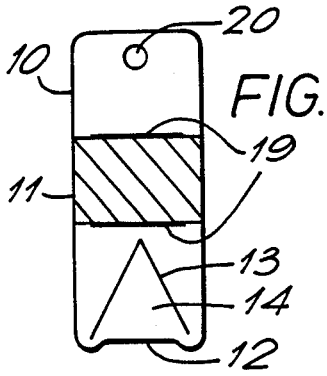
FIGS. 6–10 represent alternative forms of tab which may be adhered to the package.

In FIG. 6 the tab (10) is provided with the first portion having adhesive (11), second portion (12), precut "V" score lines (13) defining a cutter (14), a die-cut hole (20) to enable hanging of the package to which the tab is adhered and score lines (19) to allow bending.

Figure 7:
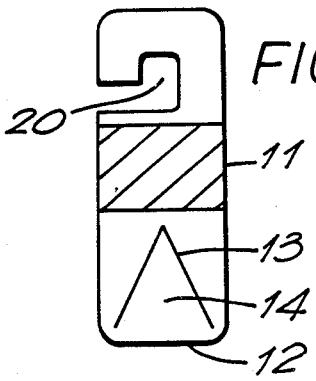
Figure 8:
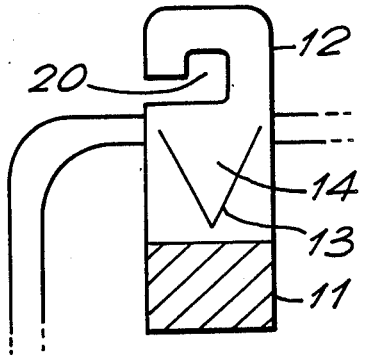

In FIGS. 7 and 8 the tab is provided with first portion having adhesive (11), second portion (12), precut "V" score lines (13) defining a cutter (14) and a notch within a third tab portion to enable hanging of the package to which the tab is adhered.

Figure 9:
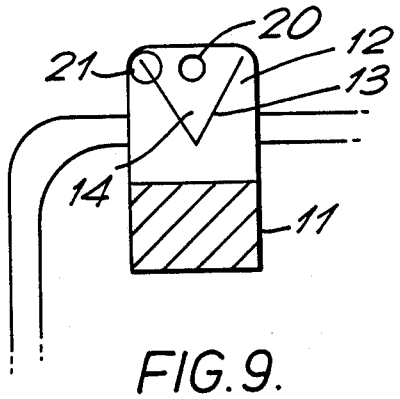

In FIG. 9 the tab is provided with the first portion having adhesive (11), second portion (12), precut "V" score lines (13) defining a cutter (14), a die-cut hole (20) within the second tab portion to enable hanging of the package to which the tab is adhered, and a pivot point (21).

Thus, as illustrated in drawing FIGS. 1–9, the tab is planar in nature, as defined by its length and breadth, and has a first planar portion for being secured to the package. A second planar tab portion, which is capable of being bent out of a plane defined by the first tab portion, contains lines of weakening which define the cutter having at least one cutting edge for enabling the cutter, by finger pressure, to be broken from the second tab portion at the lines of weakening and bent out of a plane defined by the length and breadth of the second tab portion for making effective the at least one cutting edge of the cutter for piercing the flexible package for opening the package. Thus, the first tab portion is secured to the package in a position with respect to a flexible surface of the package such that upon breaking and bending the cutter out of a plane defined by the length and breadth of the second tab portion, the cutter is made effective for piercing and assisting in opening the package.

Figure 11:
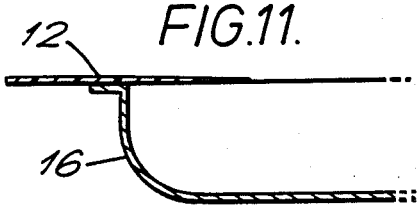
FIGS. 11–16 illustrate the steps of opening a package by means of the tab represented in FIG. 9.
Figure 12:
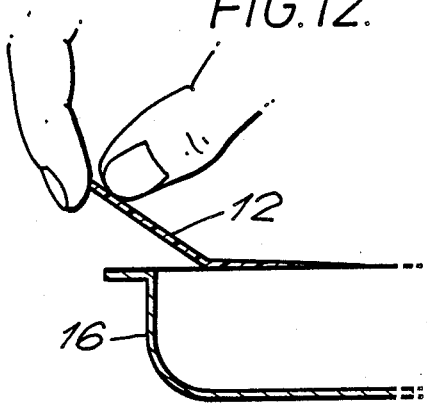
Figure 13:
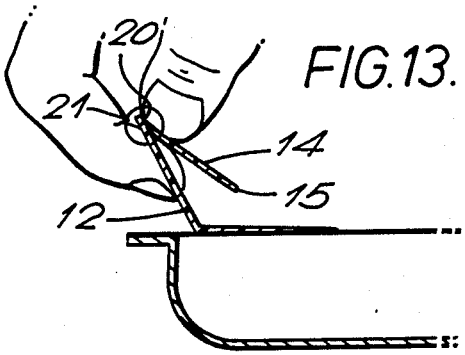
Figure 14:
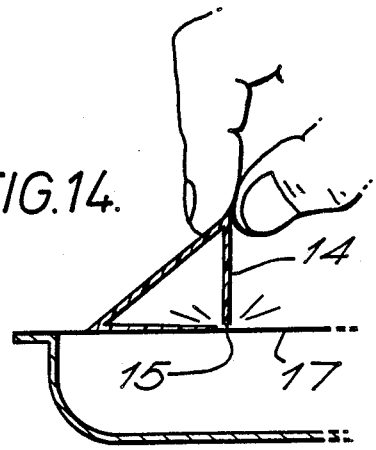
Figure 15:
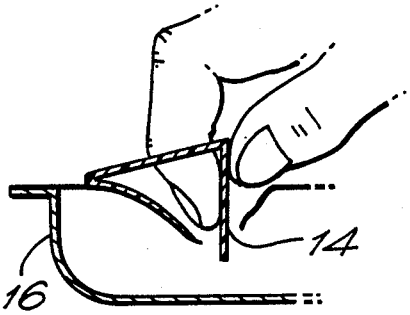
Figure 16:
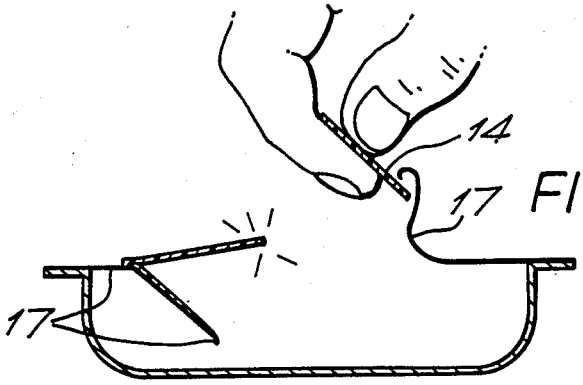
Figure 20:
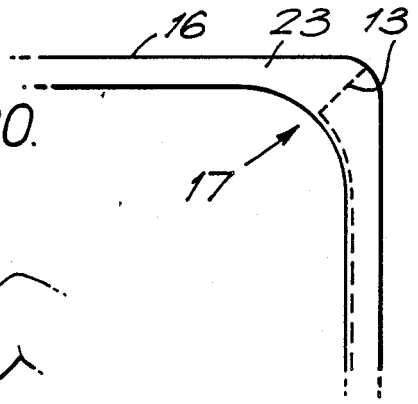
FIGS. 20–23 illustrate a form of tab integral with the package and the steps of opening the package.

To open the package represented in FIG. 9, the second portion (12) of the tab extends beyond the edge of the package (16) as shown in FIG. 11 and is lifted up as shown in FIG. 12. As shown in FIG. 13 the second portion is pulled back towards the left and then pivoted at the pivot point (21) with the fingers to break the score lines (13) to release the cutter (14) with its pointed end (15). As shown in FIG. 14 the lidding material (17) is pierced by the pointed end (15) of the cutter (14) and as shown in FIG. 15 the cutter penetrates the package while in FIG. 16, the tab and the lidding material (17) are peeled open with the fingers.

Figure 10:
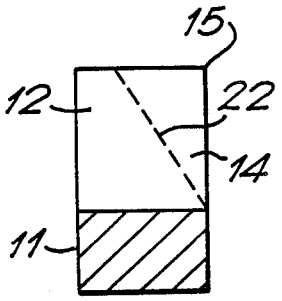

In FIG. 10 the tab is provided with the first portion having adhesive (11), second portion (12) and a perforated precut score line (22) at which the second portion of the tab can be bent to form a cutter (14) with a pointed end (15).

To open the package represented in FIG. 10, in which the tab is adhered to the lidding material (17) of the package (16) by means of the first tab portion having adhesive (11), the second portion (12) of the tab is pulled up as shown in FIG. 17 and then bent down at the perforated score (22) to form a cutter (14) with a pointed end (15) as shown in FIG. 18. As shown in FIG. 19 the cutter (14) is forced in the direction of the arrows by the fingers to pierce the lidding material with its pointed end and then the tab and lidding material are peeled back to open the package. As another option, the finger is placed into the tear and the lidding material is peeled back to open the package as illustrated in FIG. 19A.

Figure 21:
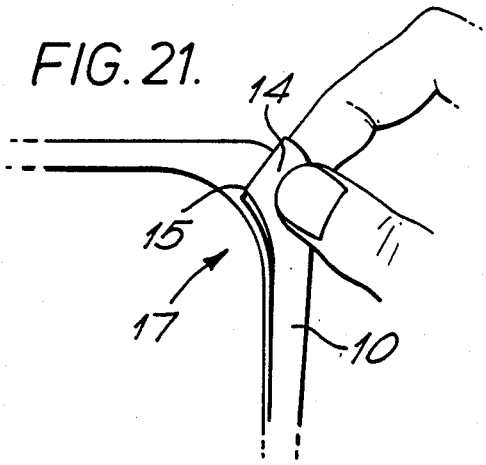
Figure 22:
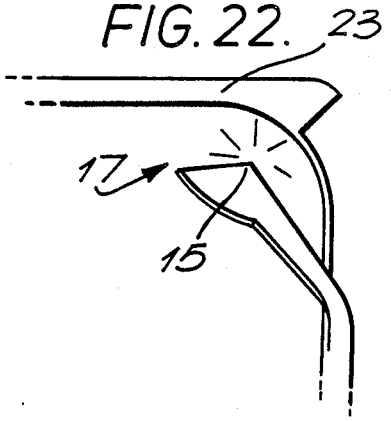
Figure 23:
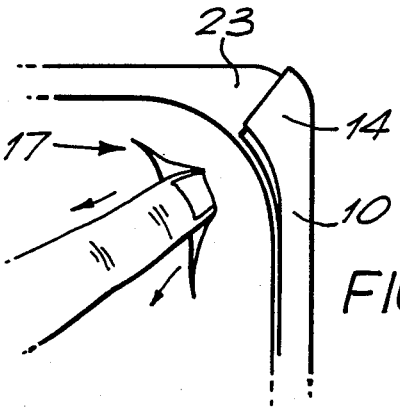

FIGS. 20 to 23 represent one corner of a flexible package (16) with a flange (23) containing perforated precut score lines (13) which can be torn or broken by finger pressure to release the tab (10) and the cutter (14) with a pointed end (15). The tab can be gripped between finger and thumb as shown in FIG. 21 and then folded so that the cutter pierces the lidding material (17) with its pointed edge as shown in FIG. 22. As shown in FIG. 23, after withdrawing the cutter, the finger is placed into the tear and the lidding material is peeled back to open the package.

FIGS. 24 to 26 represent one corner of a flexible package (16) wherein a tab (10) made of polyester is adhered to the lidding material (17) by means of a double sided adhesive (11) consisting of a polyester tape having on the side facing the lidding material an adhesive aggressive enough to hold the tape to the lidding material and on the opposite side an adhesive which secures the tab. The tab is provided with a V-shaped incision (13) penetrating completely through the material of the tab, which defines a cutter (14) with a pointed end (15) and score lines (24).

To open the package, the tab is removed completely from the lidding material and bent with the fingers about the score lines (24) until it is folded in half to expose the cutter (14) as shown in FIG. 25. The lidding material is then pierced with the pointed end (15) and cut to open the package.

FIGS. 27 to 29 represent one corner of a flexible package (16) wherein a tab (10) made of polyester is adhered to the lidding material (17) by means of a double sided adhesive (11) as in the embodiment depicted in FIGS. 24 to 26. The tab is provided with score lines (25). To open the package, the tab is removed completely from the lidding material and bent with the fingers as in FIG. 28 about the score lines (25) until it is folded in half to expose the cutting point (15) with which the lidding material is pierced and cut open.

Figure 30:
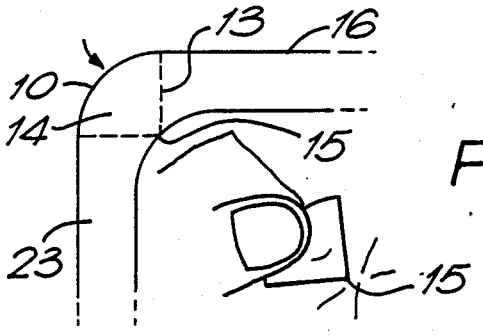
FIGS. 30–32 represent further variations of the form of tab.

FIG. 30 represents another variation where at one corner of a flexible package (16) a flange (23) is provided with a perforated V-shaped score line (13) defining a tab (10) comprising a cutter (14) with a pointed end (15). To open the package, the tab is broken off at the score line by the fingers and the pointed end (15) is used to pierce the lidding material and cut open the package.

Figure 31:
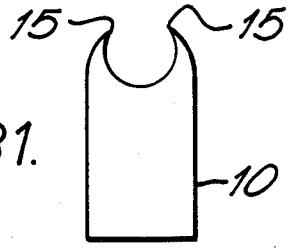

FIG. 31 represents a different form of tab (10) where the tab has two pointed ends (15) which may be adhered to the lidding material by means of a polyester tape having adhesive on one side which contacts the lidding material and at least part of the tab.

Figure 32:
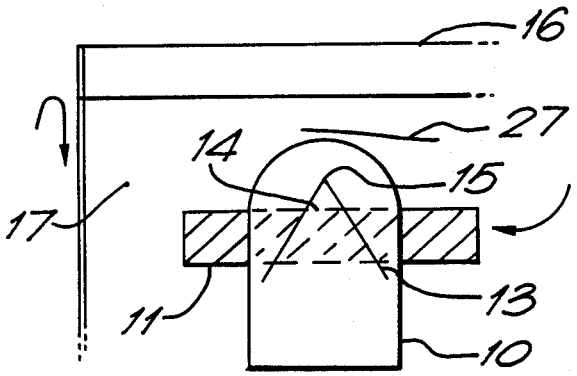

FIG. 32 represents one corner of a flexible package (16) wherein a tab (10) made of polyester is adhered to the lidding material (17) by means of a double sided adhesive (11). The tab is provided with a V-shaped incision (13) defining a cutter (14) with a pointed end (15). To open the package, the tab is removed completely from the lidding material, the cutter (14) is pushed out with the fingers to expose the pointed end (15) which is used to pierce and cut open the lidding material at position (27). If desired, after opening, the edge of the package may be folded down onto the adhesive strip to reseal the package.

I claim:

1. A package comprising at least one flexible surface and a tab integral with the package as a flange having at least one score line defining a cutter having a cutting edge, the at least one score line enabling, by finger pressure, making the cutter effective for piercing the flexible surface by enabling breaking the cutter from the remainder of the flange at the score line.

2. A device for aiding the opening of a flexible package comprising a planar tab made of resilient material configured for defining a hole for enabling the tab to be hung and having a first tab portion for being affixed to a flexible package and second tab portion having at least one line of weakening defining a cutter having at least one cutting edge, the at least one line of weakening enabling, by finger pressure, making the cutter effective for piercing a flexible surface of a flexible package for opening the package by enabling breaking the cutter from the remainer of the second tab portion at the at least one line of weakening for bending the cutter out of a plane defined by a length and breadth of the second tab portion.

3. An opening device according to claim 2 wherein the second tab portion is configured for defining the hole for enabling the tab to be hung.

4. An opening device according to claim 2 wherein the tab further comprises a third portion configured for defining the hole for enabling the tab to be hung, the third portion being delimited from the remainder of the tab by a score line for assisting bending the third portion with respect to the tab portion adjacent the third tab portion.

5. An opening device according to claim 2 wherein the second tab portion has one line of weakening defining the cutter which extends from one edge of the second tab portion to another edge of the second tab portion.

6. An opening device according to claim 2 wherein the second tab portion contains at least two lines of weakening arranged for defining a V-shaped cutter.

7. An opening device according to claim 2 wherein the tab further comprises a score line between the first and second tab portions for assisting in enabling bending the second tab portion with respect to the first tab portion.

8. A package comprising at least one flexible surface and a tab made of resilient material configured for defining a hole for enabling the tab and package to be hung, the tab having a first tab portion secured to the package and a second tab portion having at least one line of weakening defining a cutter having at least one cutting edge, the first tab portion being secured to the package in a position with respect to a flexible surface of the package such that the second tab portion is positioned for making the cutter effective for piercing the flexible surface of the package for opening the package upon breaking the cutter from the remainder of the second tab portion and bending the cutter out of a plane defined by a length and breadth of the second tab portion.

9. A package according to claim 8 wherein the second tab portion is configured for defining the hole for enabling the tab and package to be hung.

10. A package according to claim 8 wherein the tab further comprises a third portion configured for defining the hole for enabling the tab and package to be hung, the third portion being delimited from the remainder of the tab by a score line for assisting bending the third portion with respect to the tab portion adjacent the third tab portion.

11. A package according to claim 8 wherein the tab is secured to the package in a manner such that the tab is removable.

12. A package according to claim 8 wherein the second tab portion contains one line of weakening defining the cutter which extends from one edge of the tab to another edge of the tab.

13. A package according to claim 8 wherein the second tab portion contains at least two lines of weakening arranged for defining a V-shaped cutter.

14. A package according to claim 8 wherein the first tab portion is affixed to the flexible surface of the package and has its length and breadth being in a same plane as a plane of the length and breadth of the second tab portion (24).

15. A package according to claim 8 wherein the tab further comprises a score line between the first and second tab portions for assisting in enabling bending the second tab portion with respect to the first tab portion (25).

16. A package according to claim 8 wherein the tab is secured to the package by means of an adhesive (28).

17. A package according to claim 8 wherein the tab is secured to the package by means of a double-sided adhesive material (29).

* * * * *